US011129460B2

(12) United States Patent
Hong

(10) Patent No.: US 11,129,460 B2
(45) Date of Patent: Sep. 28, 2021

(54) OPENING/CLOSING NOZZLE OF DISCHARGE PUMP FOR COSMETIC CONTAINER

(71) Applicant: SAMHWA Co., LTD., Uiwang-si (KR)

(72) Inventor: Jong Nam Hong, Seoul (KR)

(73) Assignee: SAMHWA Co., LTD., Uiwang-si (KR)

( * ) Notice: Subject to any disclaimer, the term of this patent is extended or adjusted under 35 U.S.C. 154(b) by 0 days.

(21) Appl. No.: 16/954,342

(22) PCT Filed: Dec. 20, 2018

(86) PCT No.: PCT/KR2018/016297
§ 371 (c)(1),
(2) Date: Jun. 16, 2020

(87) PCT Pub. No.: WO2019/124996
PCT Pub. Date: Jun. 27, 2019

(65) Prior Publication Data

US 2021/0076796 A1 Mar. 18, 2021

(30) Foreign Application Priority Data

Dec. 22, 2017 (KR) ..... 10-2017-0178397

(51) Int. Cl.

| | |
|---|---|
| ***A45D 34/04*** | (2006.01) |
| ***A45D 40/26*** | (2006.01) |
| *A45D 34/00* | (2006.01) |
| *A45D 40/00* | (2006.01) |
| *B05B 11/00* | (2006.01) |
| *B65D 47/06* | (2006.01) |

(52) U.S. Cl.
CPC ..... *A45D 34/04* (2013.01); *A45D 40/26* (2013.01); *A45D 2034/002* (2013.01); *A45D 2040/0006* (2013.01); *A45D 2200/056* (2013.01); *B05B 11/3074* (2013.01); *B65D 47/06* (2013.01)

(58) Field of Classification Search
CPC .. A45D 34/04; A45D 40/26; A45D 2034/002; A45D 2040/0006; A45D 2200/056; B05B 11/3074; B05B 11/3002; B05B 11/3039; B65D 47/06
See application file for complete search history.

(56) References Cited

U.S. PATENT DOCUMENTS 7,048,155 B2 * 5/2006 Kuwahara ..... B05B 11/3004 222/321.9
8,245,884 B2 * 8/2012 Byeon ..... B05B 11/3053 222/256

(Continued)

FOREIGN PATENT DOCUMENTS

KR 20-0282746 Y1 7/2002
KR 20-2009-0010141 U 10/2009

(Continued)

*Primary Examiner* — Vishal Pancholi
(74) *Attorney, Agent, or Firm* — Novick, Kim & Lee, PLLC; Jae Youn Kim

(57) ABSTRACT

An opening/closing nozzle of a discharge pump for a cosmetic container is configured such that it is advantageous in that inflow of air into a nozzle of the cosmetic container can be prevented such that not only degeneration of the content and hardening of the content inside the nozzle, which would otherwise occur if air flows into the nozzle, can be prevented, but the reliability of the product can also be improved.

2 Claims, 5 Drawing Sheets

(56) References Cited

U.S. PATENT DOCUMENTS

| | | | | |
|---|---|---|---|---|
| 8,584,908 | B2 * | 11/2013 | Kakuta | B05B 11/0067 222/380 |
| 9,038,863 | B2 * | 5/2015 | Jung | B05B 11/0064 222/380 |
| 2010/0224652 | A1 * | 9/2010 | Lim | A45D 34/04 222/256 |
| 2012/0325862 | A1 * | 12/2012 | Kuwahara | B05B 11/3053 222/321.9 |
| 2014/0346196 | A1 * | 11/2014 | Byeon | B05B 11/00416 222/256 |

FOREIGN PATENT DOCUMENTS

| | | | |
|---|---|---|---|
| KR | 20-2013-0001155 | * | 2/2013 |
| KR | 20-2013-0001155 U | | 2/2013 |
| KR | 20-0465589 Y1 | | 3/2013 |
| KR | 10-1285861 B1 | | 7/2013 |

* cited by examiner

OPENING/CLOSING NOZZLE OF DISCHARGE PUMP FOR COSMETIC CONTAINER

TECHNICAL FIELD

The present invention relates to an opening/closing nozzle of a discharge pump for a cosmetic container and, more particularly, to an opening/closing nozzle of a discharge pump for a cosmetic container which may prevent air from flowing into the nozzle of the cosmetic container, thereby making it possible to improve the reliability of a product while preventing degeneration of a content and hardening of the content inside the nozzle, which occur when the air flows into the nozzle.

BACKGROUND ART

As disclosed in Korean Utility Model Registration No. 0418954, a cosmetic container is generally equipped and used with a discharge pump as one of means for discharging and using a content in a small amount.

As described above, the discharge pump that discharges and uses the content in the small amount discharges the content in the container through a nozzle formed in a pressing button by ascending and descending actions of a piston, and has an advantage of discharging and using the content in an appropriate amount. However, since the nozzle formed on the pressing button is always opened, air or various foreign substances are introduced through a nozzle inlet, and the remaining content in the nozzle is oxidized and degraded or the content on the nozzle inlet side is hardened.

Therefore, when the content is discharged and used through the nozzle formed on the pressing button of the discharge pump, the content that is initially discharged can not be used, and when the degraded content is used without consideration, skin troubles are caused to deteriorate the reliability of a product.

DISCLOSURE

Technical Problem

The present invention is invented to meet the needs of the prior arts described above, and an object of the present invention is to provide an opening/closing nozzle of a discharge pump for a cosmetic container which may prevent air from flowing into the nozzle of the cosmetic container, thereby making it possible to improve the reliability of a product while preventing degeneration of a content and hardening of the content inside the nozzle, which occur when the air flows into the nozzle.

Technical Solution

An opening/closing nozzle of a discharge pump for a cosmetic container according to a first embodiment of the present invention is characterized by including: a container body (10) for containing a cosmetic content and having an entrance portion (11) formed in the upper portion of the container body (10) such that the content can be injected through the same; a cylindrical shoulder member (20) coupled to an upper-end shoulder portion of the container body (10) and having upper/lower portions of the shoulder member (20) to be opened; an inner cap (30) which is a cylindrical member inserted through an upper hole of the shoulder member (20) and having upper/lower portions of the inner cap (30) to be opened and a lower inner peripheral edge of the inner cap (30) which is screw-coupled to the entrance portion (11) of the container body (10); a discharge pump (40) inserted into the inner cap (30) and coupled therein; an opening/closing nozzle (50) coupled to an upper end of the discharge pump (40) so as to discharge the cosmetic content by means of a pressing operation; a cover member (60) coupled to an upper side of the shoulder member (20); a piston (70) coupled to the lower inner peripheral edge of the container body (10); and a lower cover (80) covering the lower surface of the container body (10) and the outer peripheral edge thereof, wherein the opening/closing nozzle (50) includes a cylindrical lower body (51), a "¬"-shaped content transfer tube (52) formed inside the lower body (51) and connected to the discharge pump (40), an opening/closing member (54) installed in the content transfer tube (51) and operating by means of discharge pressure of the cosmetic content to open/close a discharge port (53), and an upper body (55) coupled to the upper portion of the lower body (51).

The opening/closing member (54) is characterized to include a circular rod (541) that is horizontally inserted into the content transfer tube (52); a closing ball (542) formed at one end of the horizontal rod (541) to be in close contact with the discharge port (53); an rubber-made inclined disc (543) formed on the other end of the circular rod (541) and pushed while the circular rod (541) moves in a direction to open the discharge port (53) by the discharge pressure of the cosmetic content; a fixed cylindrical tube (544) formed to be connected to the outer peripheral edge of the inclined disc (543) to be fixed to the inner peripheral edge of one side of the content transfer tube (52); and a side cover (546) surrounding the outer peripheral edge of the fixed cylindrical tube (544).

The opening/closing member (54) is characterized to further include a conical spring (545) which is inserted into the outer side surface of the inclined disc (543) and extends when the discharge pressure of the cosmetic content is released to return the inclined disc (543) to its original state.

Advantageous Effects

According to the opening/closing nozzle of the discharge pump for the cosmetic container of the present invention, the air may be prevented from flowing into the nozzle of the cosmetic container, thereby making it possible to improve the reliability of a product while preventing degeneration of the content and hardening of the content inside the nozzle, which occur when the air flows into the nozzle.

BEST MODE

Figure 1:
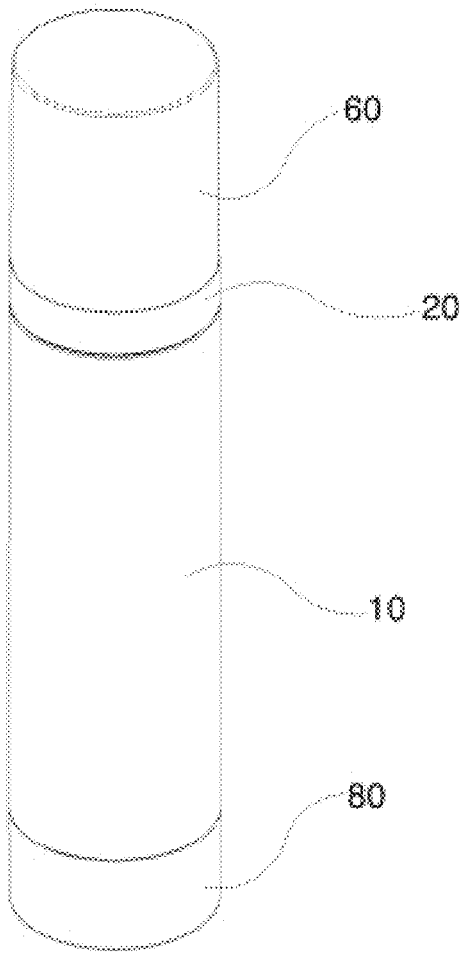
FIG. 1 is an external perspective view showing a cosmetic container of the present invention.

An opening/closing nozzle of a discharge pump for a cosmetic container according to a first embodiment of the present invention is characterized by comprising: a container body (10) for containing a cosmetic content and having an entrance portion (11) formed in the upper portion of the container body (10) such that the content can be injected through the same; a cylindrical shoulder member (20) coupled to an upper-end shoulder portion of the container body (10) and having upper/lower portions of the shoulder member (20) to be opened; an inner cap (30) which is a cylindrical member inserted through an upper hole of the shoulder member (20) and having upper/lower portions of the inner cap (30) to be opened and a lower inner peripheral edge of the inner cap (30) which is screw-coupled to the entrance portion (11) of the container body (10); a discharge pump (40) inserted into the inner cap (30) and coupled therein; an opening/closing nozzle (50) coupled to an upper end of the discharge pump (40) so as to discharge the cosmetic content by means of a pressing operation; a cover member (60) coupled to an upper side of the shoulder member (20); a piston (70) coupled to the lower inner peripheral edge of the container body (10); and a lower cover (80) covering the lower surface of the container body (10) and the outer peripheral edge thereof, wherein the opening/closing nozzle (50) comprises a cylindrical lower body (51), a "¬"-shaped content transfer tube (52) formed inside the lower body (51) and connected to the discharge pump (40), an opening/closing member (54) installed in the content transfer tube (51) and operating by means of discharge pressure of the cosmetic content to open/close a discharge port (53), and an upper body (55) coupled to the upper portion of the lower body (51).

MODES OF THE INVENTION

Hereinafter, a preferred embodiment of the present invention will be described with reference to the accompanying drawings so as to be easily implemented by those skilled in the art. In the accompanying drawings, it should be noted that the same reference numerals are used as far as possible when the reference numerals indicated in the configurations indicate the same configurations even in different drawings. In the following description of the present invention, a detailed description of known related functions and constitutions will be omitted when it is determined when the detailed description may unnecessarily make the gist of the present invention unclear. In addition, some features presented in the drawings are enlarged or reduced or simplified for ease of description, and the drawings and components thereof are not necessarily illustrated at appropriate ratios. However, those skilled in the art will easily understand these details.

Terms including an ordinal number such as first or second may be used to describe various components, but the components are not limited by the above terms. The above terminologies are used only for discriminating one component from the other component. For example, without departing from the scope of the present invention, a first component may be referred to as a second component, and similarly, the second component may be referred to as the first component. A terminology of 'and/or' includes a combination of a plurality of associated items to be disclosed or any item of the plurality of associated items to be disclosed.

In addition, relative terms described based on those shown in the drawings, such as 'front', 'rear', 'upper', and 'lower', will be replaced with ordinals such as 'first' and 'second'.

For ordinals such as 'first' and 'second', the order thereof is an order to be mentioned above or arbitrarily determined, and the order thereof may be arbitrarily changed as necessary.

Terms used in the present invention are used only to describe specific embodiments, and are not intended to limit the present invention. A singular form may include a plural unless the context clearly indicates otherwise. In the present application, it should be understood that term "comprising" or "having" indicates that a feature, a number, a step, an operation, a component, a part or the combination thereof described in the specification is present, but does not exclude a possibility of presence or addition of one or more other features, numbers, steps, operations, components, parts or combinations, in advance.

Unless defined otherwise, all terms to be used herein including technological or scientific terms have the same meaning as those generally understood by a person with ordinary skill in the art. It should be understood that terms defined in advance, which are generally used, have the same meanings as contextual meanings of associated techniques and unless apparently defined in this application, the terms are not ideally or excessively analyzed as formal meanings.

Hereinafter, preferred embodiments of the present invention will be described in detail with reference to the accompanying drawings. Further, in describing the present invention, a detailed description for known related configurations or functions will be omitted when it is determined that the detailed description may unnecessarily obscure the gist of the present invention.

Example

Figure 2:
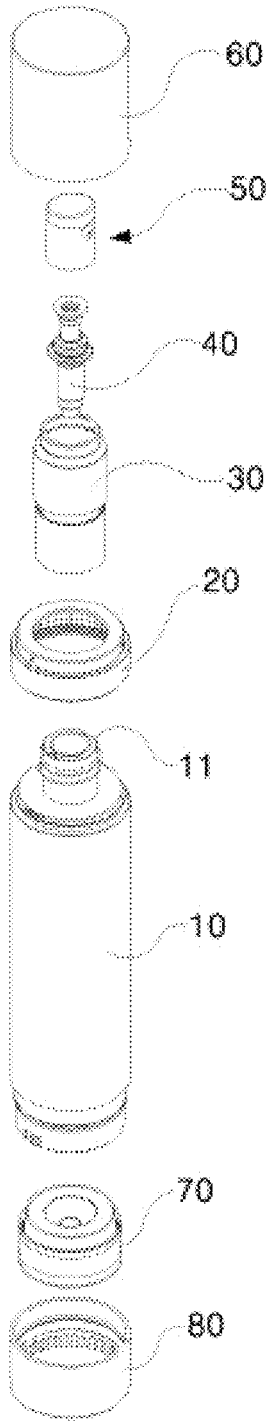
FIG. 2 is an exploded perspective view showing the cosmetic container of the present invention.
Figure 3:
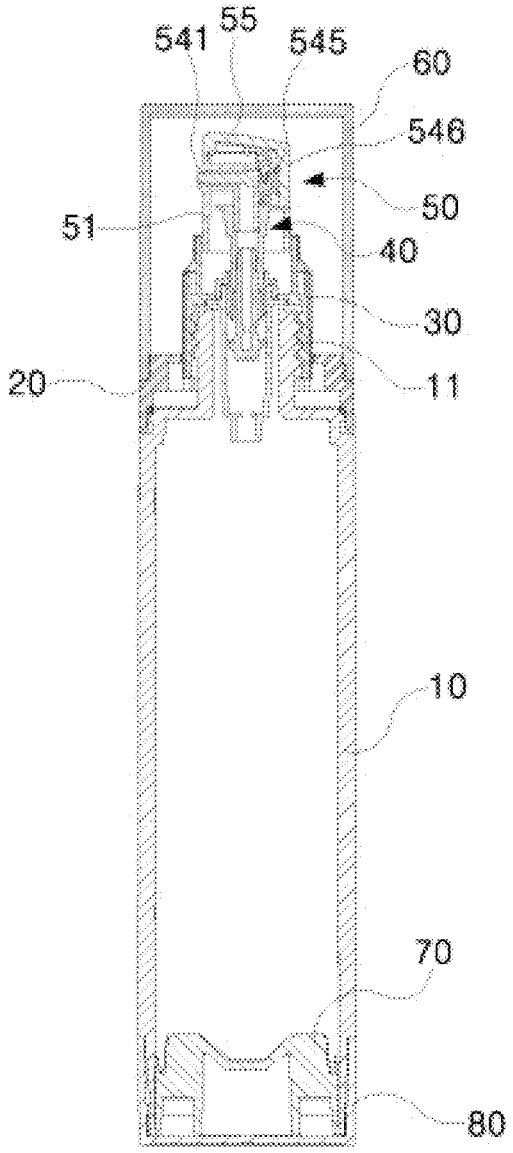
FIG. 3 is an assembly cross-sectional view showing the cosmetic container of the present invention.
Figure 4:
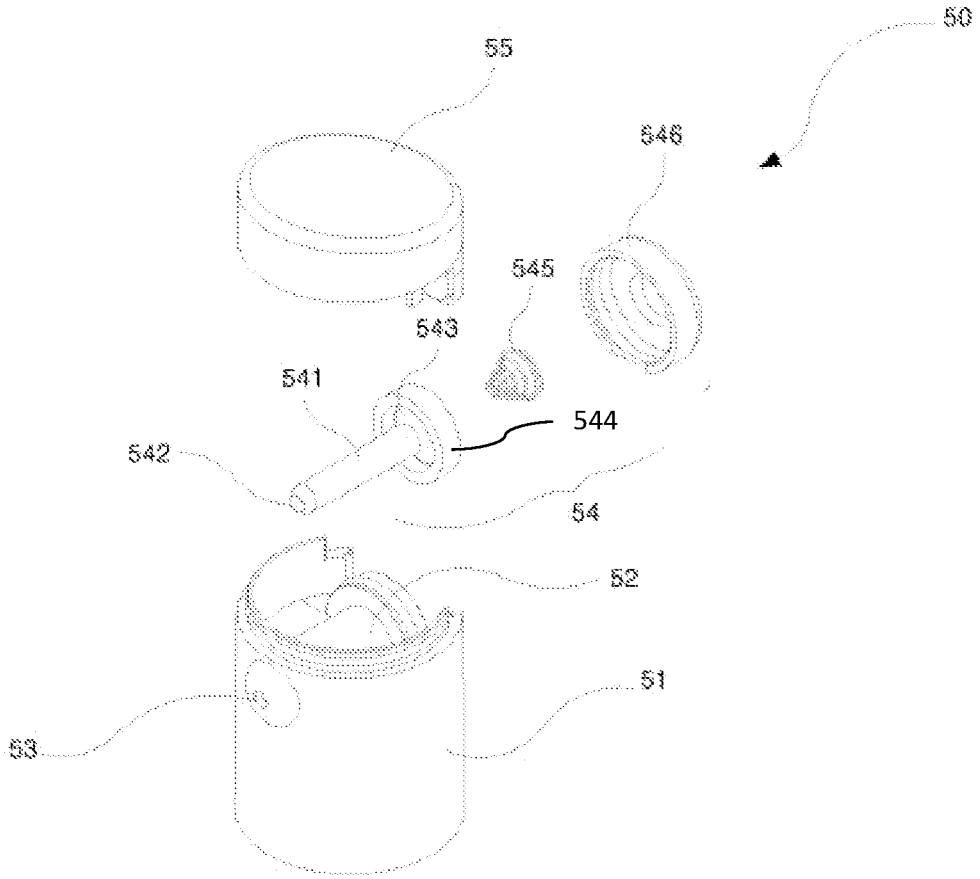
FIG. 4 is an exploded perspective view showing an opening/closing nozzle of a discharge nozzle for a cosmetic container of the present invention.
Figure 5:
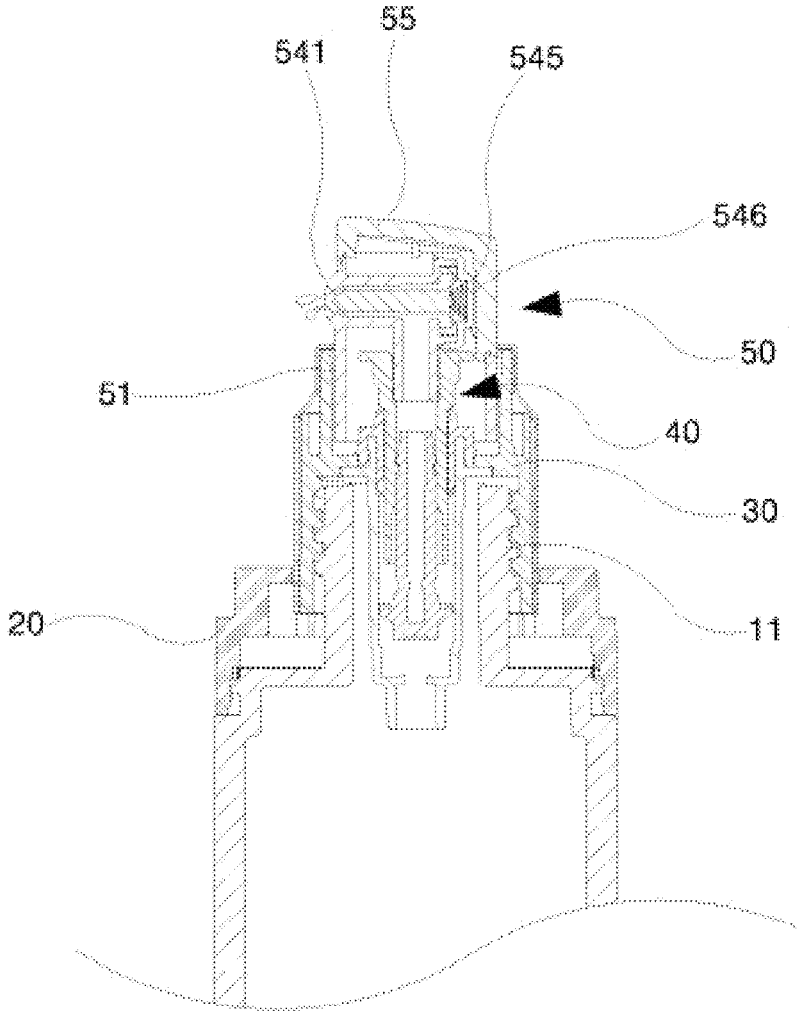
FIG. 5 is an assembly cross-sectional view showing that the opening/closing nozzle of the discharge nozzle for the cosmetic container of the present invention is operated.

FIG. 1 is an external perspective view showing a cosmetic container of the present invention, FIG. 2 is an exploded perspective view showing the cosmetic container of the present invention, FIG. 3 is an assembly cross-sectional view showing the cosmetic container of the present invention, FIG. 4 is an exploded perspective view showing an opening/closing nozzle of a discharge nozzle for a cosmetic container of the present invention, and FIG. 5 is an assembly cross-sectional view showing that the opening/closing nozzle of the discharge nozzle for the cosmetic container of the present invention is operated.

As illustrated in FIGS. 1 to 5, the cosmetic container of the present invention is constituted by a container body 10 containing a cosmetic content and having an entrance portion 11 formed in the upper portion of the container body 10 such that the content is injectable through the same, a cylindrical shoulder member 20 coupled to an upper-end shoulder portion of the container body 10 and having upper/lower portions of the shoulder member 20 to be opened, an inner cap 30 which is a cylindrical member inserted through an upper hole of the shoulder member 20 and having upper/lower portions of the inner cap 30 to be opened and a lower inner peripheral edge of the inner cap 30 which is screw-coupled to the entrance portion 11 of the container body 10, a discharge pump 40 inserted into the inner cap 30 and coupled therein, an opening/closing nozzle 50 coupled to an upper end of the discharge pump 40 so as to discharge the cosmetic content by means of a pressing operation, a cover member 60 coupled to an upper side of the shoulder member 20, a piston 70 coupled to the lower inner peripheral edge of the container body 10, and a lower cover 80 covering the lower surface of the container body 10 and the outer peripheral edge thereof.

The opening/closing nozzle 50 is constituted by a cylindrical lower body 51, a "¬"-shaped content transfer tube 52 formed inside the lower body 51 and connected to the discharge pump 40, an opening/closing member 54 installed in the content transfer tube 51 and operating by means of discharge pressure of the cosmetic content to open/close a discharge port 53, and an upper body 55 coupled to the upper portion of the lower body 51.

The opening/closing member 54 is constituted by a circular rod 541 that is horizontally inserted into the content transfer tube 52, a closing ball 542 formed at one end of the horizontal rod 541 to be in close contact with the discharge port 53, an rubber-made inclined disc 543 formed on the other end of the circular rod 541 and pushed while the circular rod 541 moves in a direction to open the discharge port 53 by the discharge pressure of the cosmetic content, a fixed cylindrical tube 544 formed to be connected to the outer peripheral edge of the inclined disc 543 to be fixed to the inner peripheral edge of one side of the content transfer tube 52; and a side cover 546 surrounding the outer peripheral edge of the fixed cylindrical tube 544.

The inclined disc 543 is made of a flexible rubber material and pushed by the discharge pressure of the cosmetic content.

Next, effects according to the operation of the present invention configured as described above will be described.

First, in order to use the cosmetic container, the upper cover member 60 is opened, and the opening/closing nozzle 50 is pressed. When the upper body 55 of the opening/closing nozzle 50 is pressed, the lower body 51 also descends at the same time to operate the discharge pump 40 inserted in a vertical portion of the content transfer tube 52. By the operation of the discharge pump 40, the cosmetic content in the container body 10 flows into the content transfer tube 52, the horizontal rod 541 is pushed toward the inclined disc 543 by the pressure to be introduced, and the closing ball 542 which has been in close contact with the discharge port 53 is removed from the discharge port 53, that is, opens the discharge port 53 while being pushed.

A certain amount of cosmetic content is discharged to the discharge port 53 opened momentarily, and when the opening/closing nozzle 50 is depressed, the discharge pressure in the content transfer tube 52 decreases. As a result, while the conical spring 545 inserted into the outer surface of the inclined disc 543 is extended, the circular rod 541 moves toward the discharge port 53 and then the closing ball 542 closes the discharge port 53 again.

As described above, the discharge port 53 is opened only when the cosmetic content is discharged and the discharge port 53 is closed when not in use, thereby improving the reliability of a product while preventing degradation of the content and hardening of the content in the nozzle, which occur when air flows into the nozzle.

As described above, the detailed embodiments have been described in the detailed description of the present invention, but a possibility that the technology of the present invention will be easily modified and implemented by those skilled in the art is apparent, and these modified embodiments will be included in the technical spirit disclosed in the appended claims of the present invention.

INDUSTRIAL AVAILABILITY

According to the opening/closing nozzle of the discharge pump for the cosmetic container of the present invention, the air is prevented from flowing into the nozzle of the cosmetic container, thereby making it possible to improve the reliability of a product while preventing degeneration of the content and hardening of the content inside the nozzle, which occur when air flows into the nozzle.

The invention claimed is:

1. A cosmetic container comprising:

a container body for containing a cosmetic content and having an entrance portion formed in an upper portion of the container body;

a cylindrical shoulder member coupled to an upper-end shoulder portion of the container body and having upper/lower portions of the shoulder member to be opened;

an inner cap which is a cylindrical member inserted through an upper hole of the shoulder member and having upper/lower portions of the inner cap to be opened and a lower inner peripheral edge of the inner cap which is screw-coupled to the entrance portion of the container body;

a discharge pump inserted into the inner cap and coupled therein;

an opening/closing nozzle coupled to an upper end of the discharge pump so as to discharge the cosmetic content by means of a pressing operation;

a cover member coupled to an upper side of the shoulder member;

a piston coupled to a lower inner peripheral edge of the container body; and a lower cover covering a lower surface of the container body and an outer peripheral edge thereof, wherein the opening/closing nozzle comprises:

a cylindrical lower body;

a "¬"-shaped content transfer tube formed inside the lower body and connected to the discharge pump;

an opening/closing member installed in the content transfer tube and operating by means of discharge pressure of the cosmetic content to open/close a discharge port; and an upper body coupled to an upper portion of the lower body, and wherein the opening/closing member further comprises:

a circular rod that is horizontally inserted into the content transfer tube;

a closing ball formed at one end of the horizontal rod to be in close contact with the discharge port;

an rubber-made inclined disc (543) formed on another end of the circular rod (541) and pushed while the circular rod (541) moves in a direction to open the discharge port (53) by the discharge pressure of the cosmetic content;

a fixed cylindrical tube (544) formed to be connected to an outer peripheral edge of the inclined disc (543) to be fixed to an inner peripheral edge of one side of the content transfer tube (52); and a side cover (546) surrounding an outer peripheral edge of the fixed cylindrical tube (544).

2. The cosmetic container of claim 1, wherein the opening/closing member further comprises a conical spring which is inserted into an outer side surface of the inclined disc and extends when the discharge pressure of the cosmetic content is released to return the inclined disc to its original state.

* * * * *